US007828612B2

(12) United States Patent
Kumakura

(10) Patent No.: US 7,828,612 B2
(45) Date of Patent: Nov. 9, 2010

(54) CRIMP TERMINAL WITH TWO PAIRS OF SHEATH FASTENING PIECES EACH PAIR FASTENING THE SHEATH IN SUPERIMPOSING REVERSE ORDER

(75) Inventor: Hideto Kumakura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/563,262

(22) Filed: Sep. 21, 2009

(65) Prior Publication Data

US 2010/0120302 A1 May 13, 2010

(30) Foreign Application Priority Data

Nov. 7, 2008 (JP) ..... 2008-286378

(51) Int. Cl.
*H01R 4/10* (2006.01)

(52) U.S. Cl. ..... 439/877

(58) Field of Classification Search ..... 439/877–880, 439/585, 578
See application file for complete search history.

(56) References Cited

U.S. PATENT DOCUMENTS 7,252,564 B1 * 8/2007 Morello et al. ..... 439/877
7,261,604 B2 * 8/2007 Brake et al. ..... 439/843
7,422,480 B1 * 9/2008 Musick et al. ..... 439/585
2002/0058447 A1 5/2002 Endo et al.
2003/0109181 A1 * 6/2003 Bungo ..... 439/852
2004/0203286 A1 * 10/2004 Kameyama ..... 439/585
2005/0227550 A1 * 10/2005 Takayama ..... 439/851
2006/0073743 A1 * 4/2006 Ford et al. ..... 439/877
2006/0216998 A1 * 9/2006 Morikawa et al. ..... 439/610

FOREIGN PATENT DOCUMENTS

JP 2000-251961 A 9/2000

* cited by examiner

*Primary Examiner*—Chandrika Prasad
(74) *Attorney, Agent, or Firm*—Sughrue Mion, PLLC

(57) ABSTRACT

A crimp terminal includes a sheath mounting portion for mounting a sheath portion of a wire thereon, at least two sheath fixing portions that press-fastens to the sheath portion of the wire, wherein each of the sheath fixing portions has a pair of sheath press-fastening pieces extended respectively from opposite side edges of the sheath mounting portion, and a crimping connection portion that electrically connects to the conductor portion of the wire exposed at a distal end of the sheath portion. Extending directions and lengths of the pair of sheath press-fastening pieces of each of the sheath fixing portions are set so that distal end portions of the pair of sheath press-fastening pieces of each of the sheath fixing portions are superposed to each other when the pair of sheath press-fastening pieces are press-fastened on the sheath portion.

2 Claims, 5 Drawing Sheets

CRIMP TERMINAL WITH TWO PAIRS OF SHEATH FASTENING PIECES EACH PAIR FASTENING THE SHEATH IN SUPERIMPOSING REVERSE ORDER

BACKGROUND

This invention relates to a crimp terminal and a wire fixing structure in a crimp terminal.

Usually, a wire used in a wire harness for installation on a vehicle has a crimp terminal connected to its distal end so that the wire can be easily electrically connected to an equipment or other wiring.

FIG. 5 shows a related crimp terminal for connection to a connector.

This crimp terminal 1 is formed by pressing a metal sheet into a predetermined shape, and includes a fitting connection portion 2 adapted to be fittingly supported in a terminal insertion hole in a connector housing so as to be fittingly connected to a terminal of a mating connector, and a wire crimping portion 4 for being connected to a distal end portion of the wire 3.

Generally, the wire crimping portion 4 includes a sheath fixing portion 5 having a pair of sheath press-fastening piece portions 5*b* and 5*c* which extend respectively from opposite side edges of a sheath mounting portion (a bottom plate portion) 5*a* extending from the fitting connection portion 2 so as to be press-fastened onto a sheath portion 3*a* of the wire 3 placed on the sheath mounting portion 5*a* to thereby fix the sheath portion 3*a*, and a crimping connection portion 7 for being electrically connected to that portion (end portion) of a conductor portion 3*b* of the wire 3 exposed at a distal end of the sheath portion 3*a* (see, for example, JP-A-2000-251961).

In the illustrated sheath fixing portion 5, the pair of sheath press-fastening piece portions 5*b* and 5*c* are tapering at their opposed side edges as at 6, that is, are decreasing in width gradually toward their distal ends, so that their distal end portions are not superposed together.

In the crimping connection portion 7, a pair of conductor press-fastening piece portions 7*b* and 7*c* extending respectively from opposite side edges of a conductor support portion 7*a* integral with the sheath mounting portion 5*a* are press-fastened onto the conductor portion 3*b* placed on the conductor support portion 7*a*, thereby crimpingly connecting the crimping connection portion 7 to the conductor portion 3*b*.

In the sheath fixing portion 5 of the related crimp terminal 1 shown in FIG. 5, the pair of sheath press-fastening piece portions 5*b* and 5*c* are offset from each other so that their distal end portions will not be superposed together. Therefore, when the pair of sheath press-fastening piece portions 5*b* and 5*c* are press-fastened onto the sheath portion 3*a* of the wire 3, pressing loads (shearing loads) f1 and f2 applied respectively from these portions 5*b* and 5*c* to the wire 3 act respectively in opposite directions, and have their respective effective load centers offset a distance L (equal to the pitch of the press-fastening piece portions 5*b* and 5*c*) from each other in the direction of the length of the wire 3.

However, in recent years, to meet requirements for lightweight and small-size (compact) designs of on-vehicle parts and others, wires for forming a wire harness have increasingly been formed into lightweight and smaller-diameter designs, so that the rigidity of such wires has become lower than before. Therefore, when the oppositely-directed pressing loads f1 and f2 acted on the wire with their effective load centers offset from each other as described above, there is a fear that the wire 3 might be bent and deformed between the effective load centers of these loads, thus causing defective press-fastening.

On the other hand, when the fastening force applied from the sheath press-fastening piece portions 5*b* and 5*c* is reduced so as to prevent the bending deformation of the wire 3, there is encountered a problem that the wire could not be firmly fixed because of insufficient fastening.

Furthermore, in recent years, the crimp terminal 1 also has been formed, using a metal sheet having a smaller thickness for the purpose of achieving a light weight design of the crimp terminal, and therefore the strength of the sheath press-fastening piece portions 5*b* and 5*c* of the sheath fixing portion 5 has been slightly lowered.

Therefore, in the structure of the related sheath fixing portion 5 (in which the pair of sheath press-fastening piece portions 5*b* and 5*c* are press-fastened on the sheath portion 3*a* in non-overlapping relation), when the wire 3 is deflected by an external force in a direction (direction T1 in FIG. 5) to unwind the sheath press-fastening piece portion 5*c* (disposed farther from the distal end of the wire 3 than the sheath press-fastening piece portion 5*b*), there is a fear that the sheath press-fastening piece portion 5*c* might be deformed by this external force (applied thereto through the wire 3) in a direction to loosen the winding of the sheath press-fastening piece portion 5*c*, so that its fixing force applied to the sheath portion 3*a* might be lowered.

SUMMARY

It is an object of this invention to solve the above problems, and more specifically to provide a crimp terminal and a wire fixing structure in a crimp terminal, in which the crimp terminal can firmly fix a sheath portion of a wire without inviting defective press-fastening due to a bending deformation of a sheath portion even when the wire is very thin and has a low rigidity, and also press-fastening piece portions wound (or press-fastened) on the wire are prevented from being deformed in an unwinding direction by an external force applied thereto through the wire, so that the properly fixed condition of the sheath press-fastening piece portions relative to the sheath portion can be maintained for a long period of time.

In order to achieve the above object, according to the present invention, there is provided a crimp terminal, comprising:

a sheath mounting portion for mounting a sheath portion of a wire thereon, wherein the wire has a conductor portion and the sheath portion covering the conductor portion;

at least two sheath fixing portions that press-fastens to the sheath portion of the wire, wherein each of the sheath fixing portions has a pair of sheath press-fastening pieces extended respectively from opposite side edges of the sheath mounting portion; and a crimping connection portion that electrically connects to the conductor portion of the wire exposed at a distal end of the sheath portion, wherein the at least two sheath fixing portions are arranged along in a longitudinal direction of the wire;

wherein extending directions and lengths of the pair of sheath press-fastening pieces of each of the sheath fixing portions are set so that distal end portions of the pair of sheath press-fastening pieces of each of the sheath fixing portions are superposed to each other when the pair of sheath press-fastening pieces are press-fastened on the sheath portion; and wherein the order of superposing of the distal end portions of the pair of sheath press-fastening pieces of one of the two adjacent sheath fixing portions is reverse to the order of superposing of the distal end portions of the pair of sheath press-fastening pieces of the other of the two adjacent sheath fixing portions.

In the construction of the above, the sheath portion of the wire is fixed by the plurality of sheath fixing portions, and therefore the strength of fixing of the wire can be increased as compared with the related crimp terminal having only one sheath fixing portion. Furthermore, the pair of sheath press-fastening pieces of each of the sheath fixing portions are so provided that their distal end portions can be superposed together. When the pair of sheath press-fastening pieces of each sheath fixing portion are press-fastened on the sheath portion, effective load centers of the fastening forces applied respectively from the sheath press-fastening pieces to the wire are not offset from each other. Therefore, when the sheath press-fastening pieces are press-fastened hard on the wire, they can firmly fix the wire without causing a bending deformation of the wire even if the wire is very thin and has a low rigidity.

Furthermore, the wire fixing structure described in the below can be achieved by using the crimp terminal.

According to the present invention, there is also provided a wire fixing structure, comprising:

a wire that includes a conductor portion and a sheath portion covering the conductor portion; and a crimp terminal that includes:

a sheath mounting portion for mounting the sheath portion of the wire;

at least two sheath fixing portions that press-fastens to the sheath portion of the wire, wherein each of the sheath fixing portions has a pair of sheath press-fastening pieces extended respectively from opposite side edges of the sheath mounting portion; and a crimping connection portion that electrically connects to the conductor portion of the wire exposed at a distal end of the sheath portion, wherein the at least two sheath fixing portions are arranged along in a longitudinal direction of the wire;

wherein distal end portions of the pair of sheath press-fastening pieces of each of the sheath fixing portions are superposed to each other when the pair of sheath press-fastening pieces are press-fastened on the sheath portion; and wherein the order of superposing of the distal end portions of the pair of sheath press-fastening pieces of one of the two adjacent sheath fixing portions is reverse to the order of superposing of the distal end portions of the pair of sheath press-fastening pieces of the other of the two adjacent sheath fixing portions.

In the wire fixing structure in which the pair of sheath press-fastening pieces are press-fastened on the sheath portion with their distal end portions superposed together, the movement of the lower sheath press-fastening piece having its distal end portion disposed under the other (upper) sheath press-fastening piece portion is limited or prevented by the upper sheath press-fastening piece, and the winding (fastening) of the lower sheath press-fastening piece on the sheath portion is hardly loosened. Therefore, even when an external force caused by a deflection of the wire and tending to loosen the winding of the lower sheath press-fastening piece is applied thereto, this sheath press-fastening piece can withstand this external force, thereby preventing the winding thereof from being loosened.

And besides, a load force acting on the conductor portion because of this external force can be suppressed, thereby maintaining proper electrical characteristics.

In the construction of the above wire fixing structure, the order of superposing of the distal end portions of the pair of sheath press-fastening pieces of one of the two adjacent sheath fixing portions is reverse to the order of superposing of the distal end portions of the pair of sheath press-fastening pieces of the other of the two adjacent sheath fixing portions. Thus, the order of overlapping of the sheath press-fastening pieces (which can effectively prevent the winding thereof from being loosened) is reverse to the order of overlapping of the sheath press-fastening pieces of the adjacent sheath fixing portion, and therefore even when an external force applied through the deflected wire acts in either of the right and left directions, the corresponding one of the two adjacent sheath fixing portions can effectively prevent the winding thereof from being loosened.

Therefore, the sheath press-fastening pieces wound on the wire are prevented from being deformed in the direction of unwinding thereof, and can maintain the proper fixed condition relative to the sheath portion for a long period of time.

The crimp terminal of the invention has at least two sheath fixing portions offset or spaced from each other in the longitudinal direction of the sheath portion, and the pair of sheath press-fastening piece portions of each sheath fixing portion are so provided that their distal end portions can be superposed together. When the pair of sheath press-fastening pieces are press-fastened on the sheath portion, the effective load centers of the fastening forces applied respectively from the sheath press-fastening pieces to the wire are not offset from each other. Therefore, when the sheath press-fastening pieces are press-fastened hard on the wire, they can firmly fix the wire without causing a bending deformation of the wire even if the wire is very thin and has a low rigidity.

In the wire fixing structure of the invention, the order of superposing of the distal end portions of the pair of sheath press-fastening pieces of one of the two adjacent sheath fixing portions is reverse to the order of superposing of the distal end portions of the pair of sheath press-fastening pieces of the other sheath fixing portion. Thus, the order of overlapping of the sheath press-fastening pieces (which can effectively prevent the winding thereof from being loosened) is reverse to the order of overlapping of the sheath press-fastening pieces of the adjacent sheath fixing portion, and therefore even when an external force applied through the deflected wire acts in either of the right and left directions, the corresponding one of the two adjacent sheath fixing portions can effectively prevent the winding thereof from being loosened.

Therefore, the sheath press-fastening pieces wound on the wire are prevented from being deformed in the direction of unwinding thereof, and can maintain the proper fixed condition relative to the sheath portion for a long period of time.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A preferred embodiment of a crimp terminal of the present invention will now be described in detail with reference to the drawings.

Figure 1:
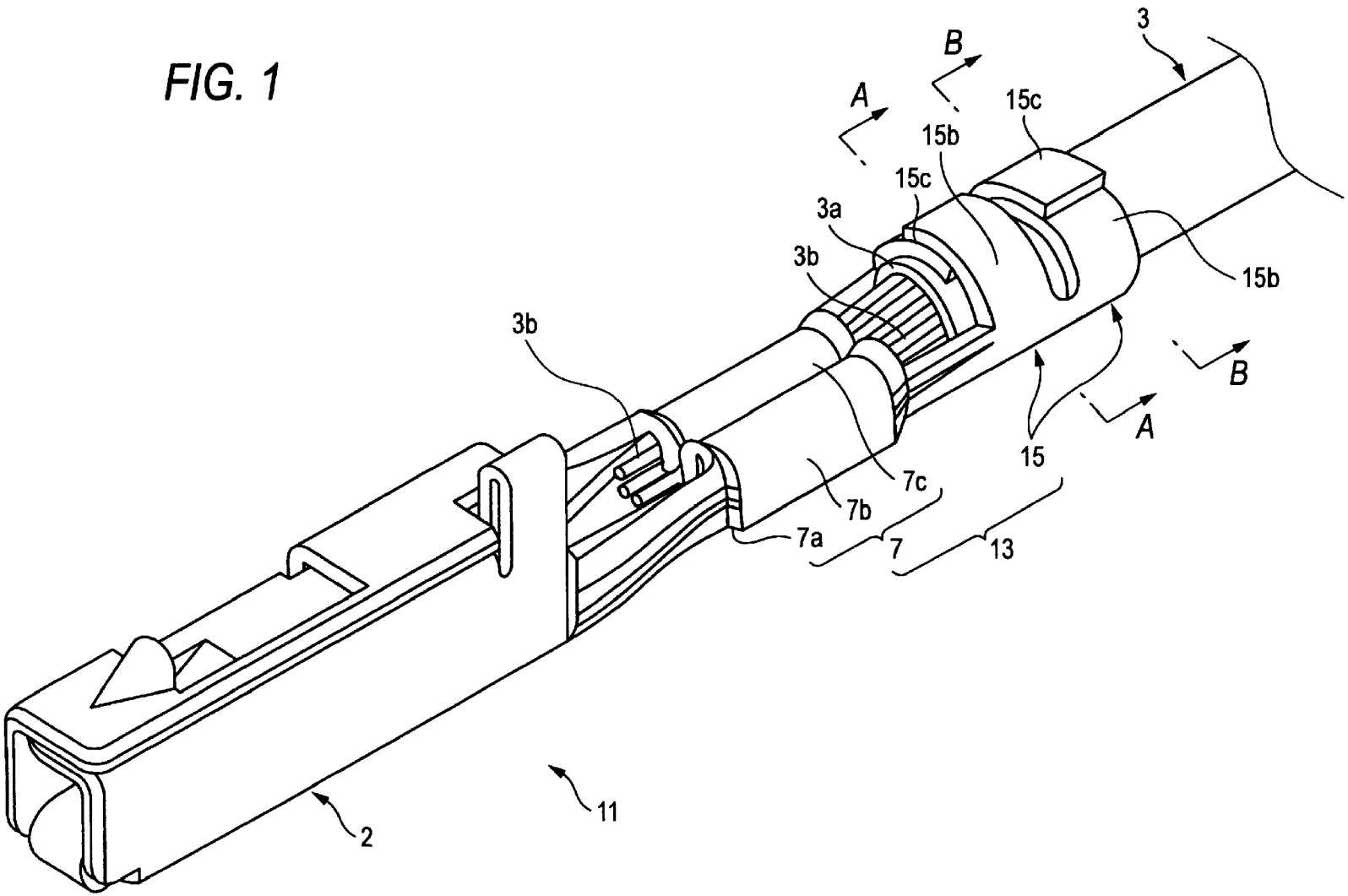
FIG. 1 is a perspective view showing one preferred embodiment of a wire fixing structure of the present invention in a crimp terminal.
Figure 2:
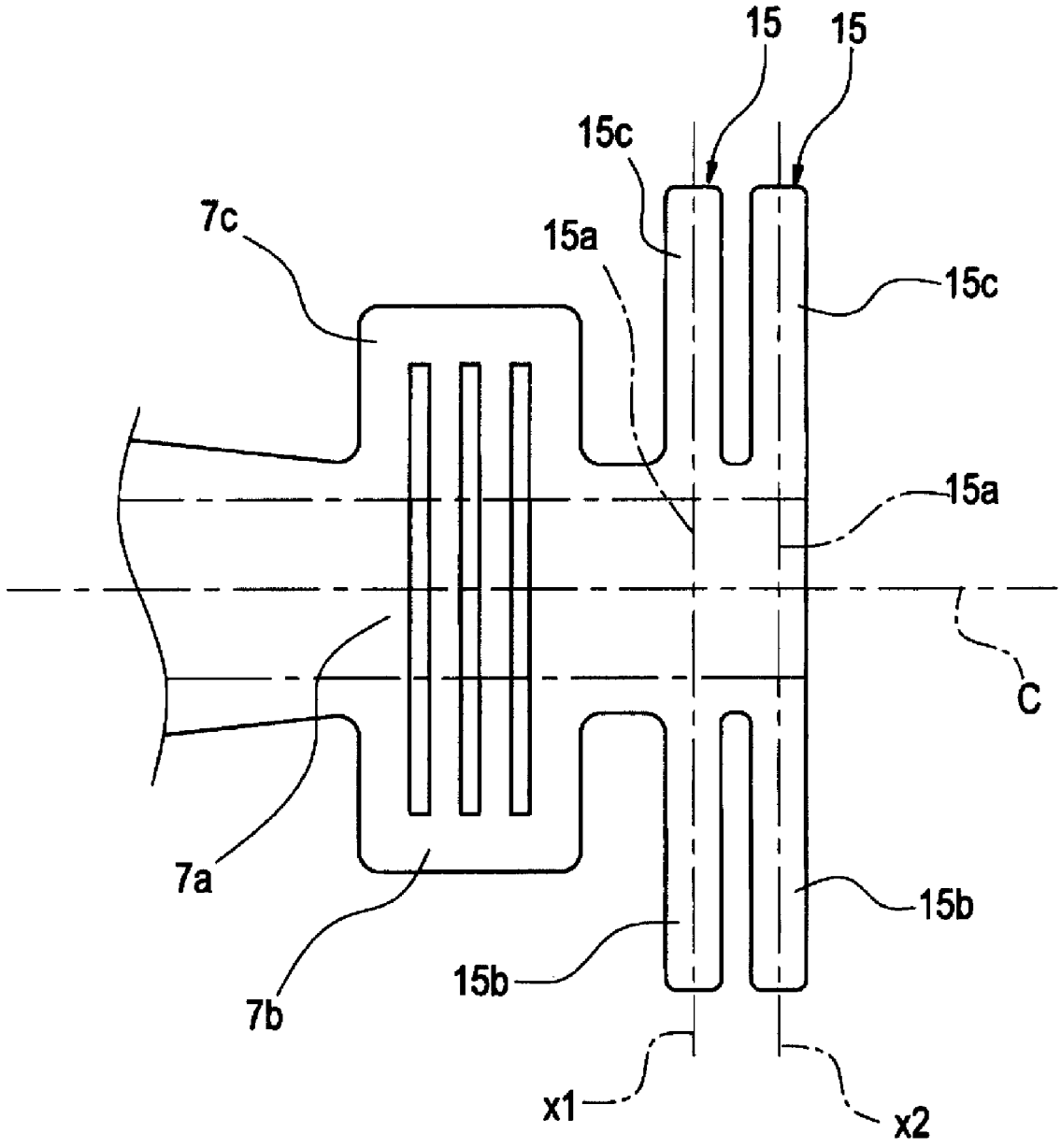
FIG. 2 is a developed view showing sheath fixing portions and a crimping connection portion of the crimp terminal of FIG. 1.
Figure 3B:
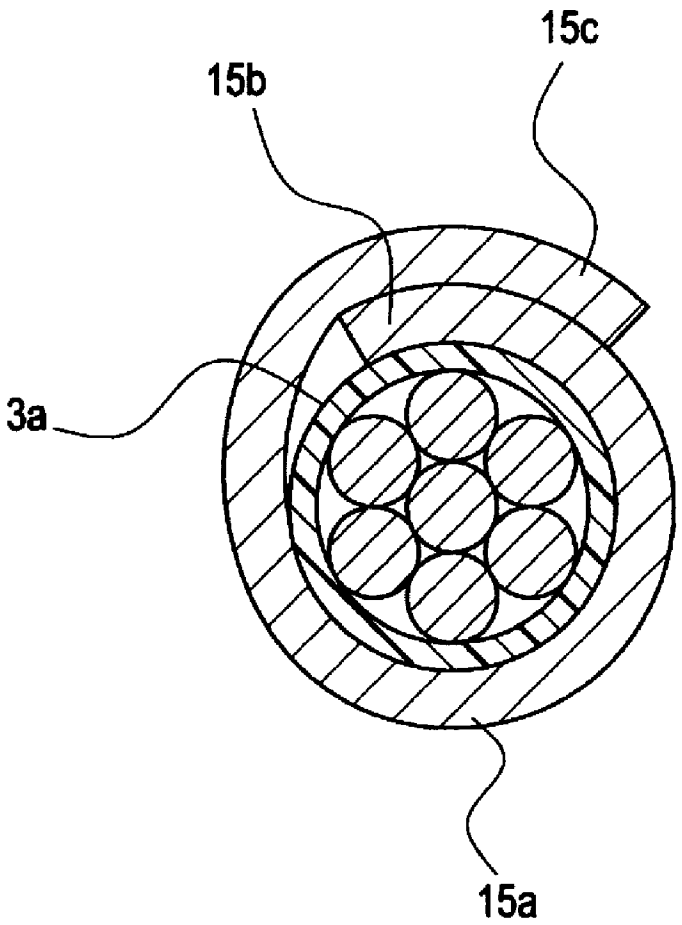
FIG. 3B is a cross-sectional view taken along the line B-B of FIG. 1.
Figure 3A:
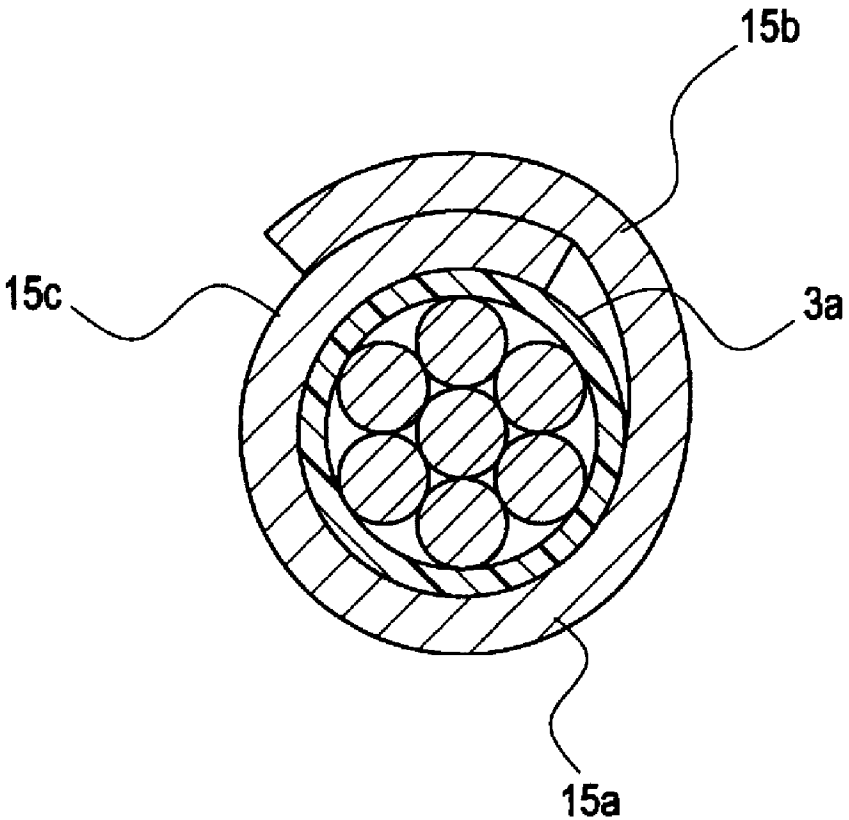
FIG. 3A is a cross-sectional view taken along the line A-A of FIG. 1.

FIG. 1 is a perspective view showing one preferred embodiment of a wire fixing structure of the invention in the crimp terminal, FIG. 2 is a developed view showing sheath fixing portions and a crimping connection portion of the crimp terminal of FIG. 1, FIG. 3A is a cross-sectional view taken along the line A-A of FIG. 1, and FIG. 3B is a cross-sectional view taken along the line B-B of FIG. 1.

The crimp terminal 11 shown in FIG. 1 is formed by pressing a metal sheet into a predetermined shape, and includes a fitting connection portion 2 adapted to be fittingly supported in a terminal insertion hole in a connector housing so as to be fittingly connected to a terminal of a mating connector, and a wire crimping portion 13 for being connected to a distal end portion of a wire 3.

In this embodiment, the wire crimping portion 13 includes two (first and second) sheath fixing portions 15 for gripping a sheath portion 3*a* of the wire 3, and the crimping connection portion 7 provided between the first sheath fixing portion 15 (close to the fitting connection portion 2) and the fitting connection portion 2.

The crimping connection portion 7 includes a pair of conductor press-fastening piece portions 7*b* and 7*c* which extend respectively from opposite side edges of a conductor support portion (bottom plate portion) 7*a* extending from the fitting connection portion 2 and are adapted to be press-fastened onto a conductor portion 3*b* placed on the conductor support portion 7*a*, thereby crimpingly connecting the crimping connection portion 7 to the conductor portion 3*b*.

In this embodiment, the first and second sheath fixing portions 15 for fixing the sheath portion 3*a* are offset or spaced from each other in a longitudinal direction of the sheath portion 3*a*.

Each of the first and second sheath fixing portions 15 includes a pair of sheath press-fastening piece portions 15*b* and 15*c* which extend respectively from opposite side edges of a sheath mounting portion (bottom plate portion) 15*a* (continuous with the conductor support portion 7*a* extending from the fitting connection portion 2) and are adapted to be press-fastened onto the sheath portion 3*a* of the wire 3 placed on the sheath mounting portion 15*a* to thereby fix the sheath portion 3*a*.

In this embodiment, the directions of extending of the pair of sheath press-fastening piece portions 15*b* and 15*c* of each sheath fixing portion 15 and their length are so determined that when the pair of sheath press-fastening piece portions 15*b* and 15*c* are press-fastened on the sheath portion 3*a*, their distal end portions are superposed together.

More specifically, as shown in FIG. 2 (which is the developed view), the pair of sheath press-fastening piece portions 15*b* and 15*c* of each sheath fixing portion 15 are arranged on a straight line x1, x2 perpendicular to a center axis C in aligned relation to each other.

Further, in the wire fixing structure shown in FIG. 1, when fixing the sheath portion 3*a* of the wire 3 to each sheath fixing portion 15, the order of superposing of the distal end portions of the pair of sheath press-fastening piece portions 15*b* and 15*c* of the first sheath fixing portion 15 (that is, one of the two adjacent sheath fixing portions 15) is reverse to the order of superposing of the distal end portions of the pair of sheath press-fastening piece portions 15*b* and 15*c* of the second sheath fixing portion 15 (that is, the other of the two adjacent sheath fixing portions).

Referring to the illustrated example of FIG. 1, as shown in FIG. 3A, the pair of sheath press-fastening piece portions 15*b* and 15*c* of the first sheath fixing portion 15 disposed close to the fitting connection portion 2 are press-fastened on the sheath portion 3*a* such that the sheath press-fastening piece portion 15*b* extending at the right side (as seen from the distal end of the terminal) overlaps the sheath press-fastening piece portion 15*c* extending at the left side. On the other hand, as shown in FIG. 3B, the pair of sheath press-fastening piece portions 15*b* and 15*c* of the second sheath fixing portion 15 remote from the fitting connection portion 2 are press-fastened on the sheath portion 3*a* such that the sheath press-fastening piece portion 15*c* extending the left side (as seen from the distal end of the terminal) overlaps the sheath press-fastening piece portion 15*b* extending at the right side.

Figure 5:
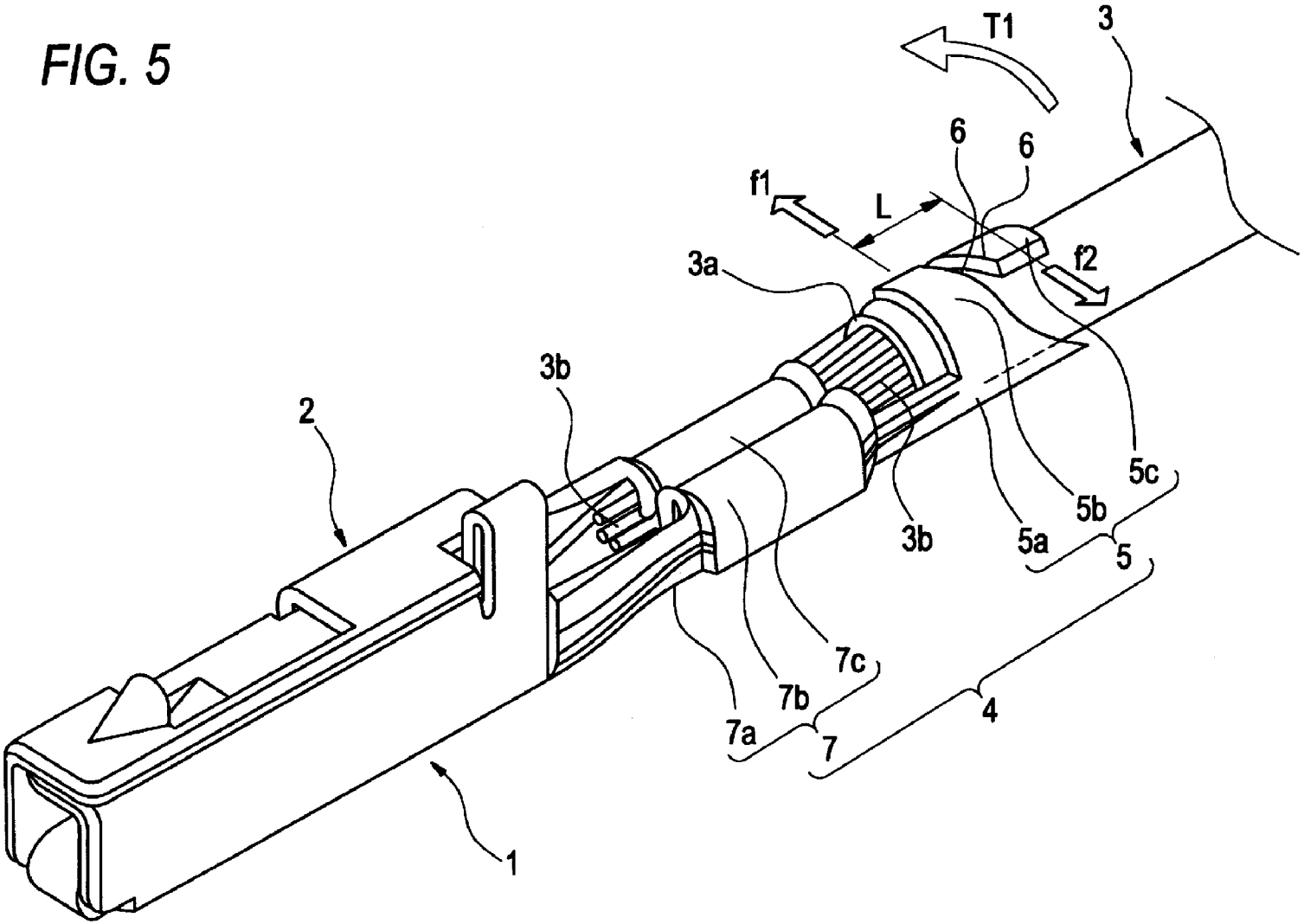
FIG. 5 is a perspective view showing a related wire fixing structure in a crimp terminal.

In the above crimp terminal 11, the sheath portion 3*a* of the wire 3 is fixed by the two sheath fixing portions 15, and therefore the strength of fixing of the wire 3 can be increased as compared with the conventional crimp terminal 1 (see FIG. 5) having only one sheath fixing portion.

And besides, the pair of sheath press-fastening piece portions 15*b* and 15*c* of each sheath fixing portion 15 are so provided that their distal end portions can be superposed together, and also the pair of sheath press-fastening piece portions 15*b* and 15*c* are not offset from each other in the longitudinal direction of the wire 3. Therefore, when the pair of sheath press-fastening piece portions 15*b* and 15*c* are press-fastened on the sheath portion 3*a*, effective load centers of the fastening forces applied respectively from the sheath press-fastening piece portions 15*b* and 15*c* to the wire 3 are not offset from each other. Therefore, when the sheath press-fastening piece portions 15*b* and 15*c* are press-fastened hard on the wire 3, they can firmly fix the wire 3 without causing a bending deformation of the wire 3 even if the wire 3 is very thin and has a low rigidity.

Furthermore, there can be provided the wire fixing structure in which when fixing the sheath portion 3*a* of the wire 3 to the two sheath fixing portions 15, the order of superposing of the distal end portions of the pair of sheath press-fastening piece portions 15*b* and 15*c* of the first sheath fixing portion 15 is reverse to the order of superposing of the distal end portions of the pair of sheath press-fastening piece portions 15*b* and 15*c* of the second sheath fixing portion 15, as shown in FIG. 1.

Furthermore, in the wire fixing structure in which each pair of sheath press-fastening piece portions 15*b* and 15*c* are press-fastened on the sheath portion 3*a* with their distal end portions superposed together, the movement of the lower sheath press-fastening piece portion having its distal end portion disposed under the other (upper) sheath press-fastening piece portion is limited or prevented by the upper sheath press-fastening piece portion, and the winding (fastening) of the lower sheath press-fastening piece portion on the sheath portion 3*a* is hardly loosened. Therefore, even when an external force tending to loosen the winding of the lower sheath press-fastening piece portion is applied thereto, this sheath press-fastening piece portion will not be deformed by this external force, and can maintain the fixed condition of the sheath portion 3*a*.

Figure 4B:
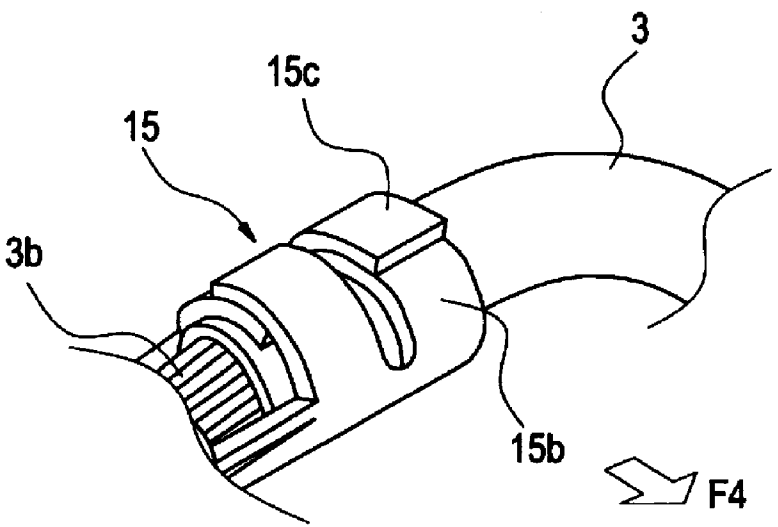
FIG. 4B is a view explanatory of an operation in which the wire is deflected left in the crimp terminal wire fixing structure of FIG. 1.
Figure 4A:
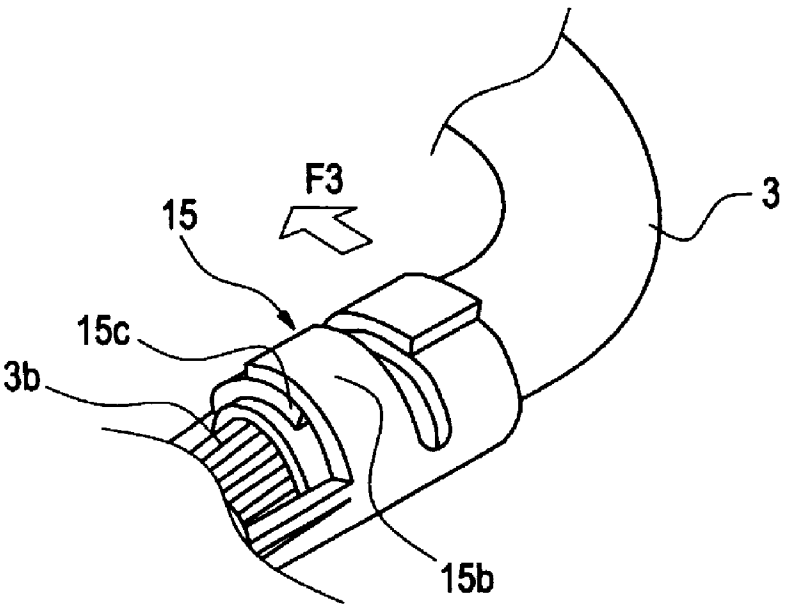
FIG. 4A is a view explanatory of an operation in which a wire is deflected right in the crimp terminal wire fixing structure of FIG. 1.

For example, in the wire fixing structure shown in FIG. 3A, the sheath press-fastening piece portion 15*c* extending at the left side (as seen from the distal end of the terminal) has the distal end portion disposed under the other sheath press-fastening piece portion 15*b*, and therefore can exert a large fixing force withstanding an external force F3 (see FIG. 4A) tending to loosen the winding thereof, and can maintain the fixed condition relative to the sheath portion 3*a*.

On the other hand, in the wire fixing structure shown in FIG. 3B, the sheath press-fastening piece portion 15*b* extending at the right side (as seen from the distal end of the terminal) has the distal end portion disposed under the other sheath press-fastening piece portion 15*c* as is reverse to the wire fixing structure of FIG. 3A, and therefore can exert a large fixing force withstanding an external force F4 (see FIG. 4B) tending to loosen the winding thereof, and can maintain the fixed condition of the sheath portion 3*a*.

Namely, in the wire fixing structure shown in FIG. 1, the two adjacent sheath fixing portions 15 can respectively withstand the external forces acting respectively in the opposite directions. Therefore, even when the external force applied through the deflected wire 3 acts in either of the right and left directions, the corresponding one of the two sheath fixing portions 15 can effectively prevent the winding thereof from being loosened. Therefore, the sheath press-fastening piece portions wound on the wire are prevented from being deformed in the direction of unwinding thereof, and can maintain the proper fixed condition relative to the sheath portion 3*a* for a long period of time.

The present invention is not limited to the above embodiment, and suitable modifications, improvements, etc., can be made. The material, shape, dimensions, numerical values, form, number, disposition, etc., of each of the constituent elements of the above embodiment are arbitrary and are not limited in so far as the invention can be achieved.

For example, the crimp terminal can include three or more sheath fixing portions spaced or offset from each other in the longitudinal direction of the sheath portion.

In this case, also, the directions of extending of the pair of sheath press-fastening piece portions of each sheath fixing portion and their length are so determined that when the pair of sheath press-fastening piece portions are press-fastened on the sheath portion, their distal end portions are superposed together. Further, preferably, when fixing the sheath portion of the wire to the sheath fixing portions, the order of superposing of the distal end portions of the pair of sheath press-fastening piece portions of one of any two adjacent sheath fixing portions is reverse to the order of superposing of the distal end portions of the pair of sheath press-fastening piece portions of the other of the two adjacent sheath fixing portions.

The present application is based on Japanese Patent Application No. 2008-286378 filed on Nov. 7, 2008, the contents of which are incorporated herein for reference.

What is claimed is:

1. A crimp terminal, comprising:

a sheath mounting portion for mounting a sheath portion of a wire thereon, wherein the wire has a conductor portion and the sheath portion covering the conductor portion;

at least two sheath fixing portions that press-fastens to the sheath portion of the wire, wherein each of the sheath fixing portions has a pair of sheath press-fastening pieces extended respectively from opposite side edges of the sheath mounting portion; and a crimping connection portion that electrically connects to the conductor portion of the wire exposed at a distal end of the sheath portion, wherein the at least two sheath fixing portions are arranged along in a longitudinal direction of the wire;

wherein extending directions and lengths of the pair of sheath press-fastening pieces of each of the sheath fixing portions are set so that distal end portions of the pair of sheath press-fastening pieces of each of the sheath fixing portions are superposed to each other when the pair of sheath press-fastening pieces are press-fastened on the sheath portion; and wherein the order of superposing of the distal end portions of the pair of sheath press-fastening pieces of one of the two adjacent sheath fixing portions is reverse to the order of superposing of the distal end portions of the pair of sheath press-fastening pieces of the other of the two adjacent sheath fixing portions.

2. A wire fixing structure, comprising:

a wire that includes a conductor portion and a sheath portion covering the conductor portion;

a crimp terminal that includes:

a sheath mounting portion for mounting the sheath portion of the wire;

at least two sheath fixing portions that press-fastens to the sheath portion of the wire, wherein each of the sheath fixing portions has a pair of sheath press-fastening piece extended respectively from opposite side edges of the sheath mounting portion; and a crimping connection portion that electrically connects to the conductor portion of the wire exposed at a distal end of the sheath portion, wherein the at least two sheath fixing portions are arranged along in a longitudinal direction of the wire;

wherein distal end portions of the pair of sheath press-fastening pieces of each of the sheath fixing portions are superposed to each other when the pair of sheath press-fastening pieces are press-fastened on the sheath portion; and wherein the order of superposing of the distal end portions of the pair of sheath press-fastening pieces of one of the two adjacent sheath fixing portions is reverse to the order of superposing of the distal end portions of the pair of sheath press-fastening pieces of the other of the two adjacent sheath fixing portions.

* * * * *